US008528459B2

(12) United States Patent
Plavnik

(10) Patent No.: US 8,528,459 B2
(45) Date of Patent: Sep. 10, 2013

(54) CUSHIONING SYSTEM FOR PNEUMATIC CYLINDER OF DIFFERENTIAL ENGINE

(75) Inventor: Gennady Plavnik, Indian Creek, IL (US)

(73) Assignee: Wabtec Holding Corp., Wilmerding, PA (US)

( * ) Notice: Subject to any disclaimer, the term of this patent is extended or adjusted under 35 U.S.C. 154(b) by 877 days.

(21) Appl. No.: 12/532,491

(22) PCT Filed: Apr. 10, 2008

(86) PCT No.: PCT/US2008/059882

§ 371 (c)(1),
(2), (4) Date: Feb. 17, 2010

(87) PCT Pub. No.: WO2008/124816

PCT Pub. Date: Oct. 16, 2008

(65) Prior Publication Data

US 2010/0139475 A1 Jun. 10, 2010

Related U.S. Application Data

(60) Provisional application No. 60/922,598, filed on Apr. 10, 2007.

(51) Int. Cl.
*E05F 3/04* (2006.01)

(52) U.S. Cl.
USPC ..... 91/395; 91/405; 16/71

(58) Field of Classification Search
USPC ..... 91/395, 404, 405, 409; 16/16, 71, 16/DIG. 7, DIG. 9
See application file for complete search history.

(56) References Cited

U.S. PATENT DOCUMENTS

| | | | | | |
|---|---|---|---|---|---|
| 1,557,684 | A | | 10/1925 | Gottschalk | |
| 1,836,383 | A | | 12/1931 | Mitchell | |
| 1,849,417 | A | | 3/1932 | Bassett | |
| 2,343,316 | A | * | 3/1944 | Newkirk | 91/395 |
| 2,638,340 | A | | 5/1953 | Koenig et al. | |
| 2,646,981 | A | | 7/1953 | Bassett et al. | |
| 2,733,918 | A | | 2/1956 | Fischer | |
| 3,034,482 | A | * | 5/1962 | Rader | 91/405 |
| 3,408,683 | A | | 11/1968 | Zahn | |
| 3,477,177 | A | * | 11/1969 | Tucker, Jr. | 91/409 |
| 3,858,920 | A | | 1/1975 | Erickson | |
| 3,916,567 | A | | 11/1975 | Daugirdas | |
| 3,979,790 | A | | 9/1976 | Chiarappa | |
| 4,134,231 | A | | 1/1979 | Daugirdas et al. | |
| 4,231,192 | A | | 11/1980 | Daugiras et al. | |

(Continued)

FOREIGN PATENT DOCUMENTS

| | | | |
|---|---|---|---|
| DE | 202006002727 | U1 | 4/2006 |
| EP | 1729015 | A1 | 6/2006 |
| JP | 59107311 | U | 7/1984 |

*Primary Examiner* — Thomas E Lazo
(74) *Attorney, Agent, or Firm* — The Webb Law Firm

(57) ABSTRACT

A cushioning system for a pneumatic cylinder powered differential engine door opening and closing device for use in passenger transportation vehicles wherein the cushioning initiation point can be adjusted. This cushioning initiation point is adjusted through the use of a linearly adjustable slider member within the large cylinder. The slider is linearly adjustable through the use of an adjustment screw located outside of the pneumatic cylinder and allows one to adjust the time and the mode of the opening/closing of power doors, without disassembly of the cylinder, and significantly improve the safety of the passenger.

20 Claims, 7 Drawing Sheets

(56) References Cited

U.S. PATENT DOCUMENTS

| | | | | |
|---|---|---|---|---|
| 4,263,694 | A | 4/1981 | Jentsch | |
| 4,367,610 | A | 1/1983 | Goode | |
| 4,478,131 | A | 10/1984 | Liermann et al. | |
| 4,638,717 | A * | 1/1987 | Carr | 91/395 |
| 4,660,250 | A | 4/1987 | Tillman et al. | |
| 4,901,474 | A | 2/1990 | Bayard et al. | |
| 5,148,631 | A | 9/1992 | Bayard et al. | |
| 5,157,806 | A | 10/1992 | Wartian | |
| 5,195,210 | A | 3/1993 | Lee | |
| 5,259,345 | A | 11/1993 | Richeson | |
| 5,307,729 | A * | 5/1994 | Hedlund | 91/409 |
| 5,549,033 | A * | 8/1996 | Manini | 16/71 |
| 6,141,908 | A | 11/2000 | Bowen | |
| 6,435,072 | B2 * | 8/2002 | Hirano et al. | 91/409 |
| 6,481,160 | B1 | 11/2002 | Kowalczyk | |
| 6,530,178 | B1 | 3/2003 | Kowalczyk et al. | |
| 6,712,406 | B2 | 3/2004 | Stojc | |
| 6,739,092 | B2 | 5/2004 | Heffner et al. | |
| 7,004,516 | B2 | 2/2006 | Stojc | |

* cited by examiner

CUSHIONING SYSTEM FOR PNEUMATIC CYLINDER OF DIFFERENTIAL ENGINE

BACKGROUND OF THE INVENTION

1. Field of the Invention

The invention relates in general to a pneumatic cylinder powered system for opening and closing a vehicle door and, more particularly, to an adjustable cushioning system for a pneumatic cylinder powered differential engine door opening and closing device for use in passenger transportation vehicles.

2. Description of Related Art

Pneumatic cylinders have been utilized in mechanical systems to convert compressed air into linear reciprocating movement for opening and closing doors of passenger transportation vehicles. An example of this type of door actuating system is shown in U.S. Pat. No. 3,979,790.

Typically, pneumatic cylinders used in this environment consist of a cylindrical chamber, a piston, and two end caps hermetically connected to the cylindrical chamber. The end caps have holes extending therethrough to allow the compressed air to flow into and out of the cylindrical chamber, to cause the piston to move in a linear direction, and to apply either an opening or closing force to the vehicle door.

Pneumatic cylinder/differential engine systems have also been designed for opening and closing doors of passenger transportation vehicles. Examples of these systems are shown in U.S. Pat. Nos. 4,231,192; 4,134,231; and 1,557,684.

It has been determined in some instances that there is a need to slow the movement of the piston at the end of the stroke when opening and/or closing the door. A known technique for slowing this stroke is by restricting the flow of the exhaust air out of the cylindrical chamber. This is commonly known as cushioning the movement of the piston.

A known cushioning system for a pneumatically powered differential engine door opening device is shown schematically in FIG. 1. The differential engine includes a housing comprising a large diameter cylinder 1 and a small diameter cylinder 2, closed at their ends by caps 6 and 7. A large diameter piston 4 is installed in the large cylinder 1 and a small diameter piston 5 is installed in the small cylinder 2. A toothed rack 16 is attached to and extends between the large piston 4 and small piston 5. The toothed rack 16 is engaged with a pinion gear 15. The pinion gear 15 is, in turn, connected to a shaft 14 which drives the mechanism for closing and opening the vehicle door. Linear movement of pistons 4 and 5 causes linear movement of the toothed rack 16. This linear movement is converted into rotational movement of the pinion gear 15 and shaft 14 causing opening and/or closing of the vehicle door as viewed in FIG. 1, movement of the pistons 4 and 5 to the left causes an opening of the doors and movement of pistons 4 and 5 to the right causes a closing of the doors.

As shown in FIG. 1, the right outer side of the small cylinder 2 is connected through a hole 19 in the cap 7 to a reservoir of compressed air that constantly applies a positive pressure to the small piston 5. As shown in schematically in FIG. 2, the cap 6, attached to the outer end of the large cylinder 1, has a chamber 17 including holes 9 and 10 which are connected through a port yy to a three-way valve, which provides connections to a source of compressed air and to an exhaust. During closing of the doors, hole 9 is connected to a source of pressurized air and exhaust hole 10 is closed. Because the surface area of piston 4 is greater than the surface area of piston 5, the pistons 4, 5 move to the right, rotating the pinion gear 15/shaft 14 in a counter-clockwise direction. During an opening stroke, holes 9 and 10 are connected to an exhaust, causing the air to flow out of large cylinder 1. Because the small piston 5 is constantly attached to a source of positive air pressure, the exhausting of the air pressure from within the large cylinder 1 causes the pistons 4, 5 connected by toothed rack 16 to move toward the left within the large and small cylinders 1, 2. This movement to the left rotates the pinion gear 15/shaft 14 in a clockwise direction to initiate opening of the doors.

In this design, cushioning at the end of the opening piston stroke occurs through the use of a small hole 11 having a diameter that is substantially smaller than that of opening xx. This hole 11 is located at a side surface of chamber 17 which provides connection to the inside volume of the chamber of the large cylinder 1. A cylindrical sealing disk 8 is installed between the piston 4 and cap 6 and is supported between two springs 12 and 13. The leftward movement of the pistons 4, 5 causes compression of springs 12 and 13 bringing the disk 8 into contact with a face 17*a* of chamber 17 forming a seal with the chamber face 17*a*. Once this seal is achieved, air can no longer exit the chamber of the large cylinder 1 through opening xx into chamber 17 and thus can only exit through hole 11 into chamber 17. Since the diameter of hole 11 is smaller than the diameter of opening xx, the flow of the air out of the large cylinder 1 is restricted, consequently slowing down the speed of the opening piston stroke movement to the left and achieving a cushioning effect during opening of the doors.

U.S. Pat. No. 2,343,316 teaches a pneumatic cylinder/differential engine for power operated doors wherein cushioning occurs near the end of the piston stroke during closing of the doors in order to prevent slamming. In this device, cushioning occurs when a sealing disk contacts with the surface of a cap, causing the exhaust air to flow through a small hole which significantly reduces the rate of flow of the exhaust air from the cylinder housing and decreases the linear speed of the piston.

While the concept of cushioning the end of a piston stroke in a door opening or door closing cycle has been documented, a disadvantage of these systems is that cushioning is always initiated at the same point in the movement of the piston (or at the same position of the piston), and because the linear movement of the piston is transferred to the rotational movement of the output shaft and rotation or linear movement of the powered doors, the doors will always begin to slow at the same point in its path. It is difficult and cost prohibitive to disassemble the pneumatic cylinder, remove the existing components of the cushioning system, replace the spring system supporting the sealing disks, and then reassemble the pneumatic cylinder. Furthermore, if one should select the wrong tensioned spring system, then the process of disassembling/reassembling must be repeated. Another disadvantage of these known systems is that it is impossible to finely adjust the cushion initiation point in the broad range of the linear movement of the piston or rotational movement of the output shaft and, respectively, linear or rotational movement of the power doors.

SUMMARY OF THE INVENTION

It is therefore an aspect of the invention to provide a cushioning system wherein the cushioning initiation point can be adjusted. It is a further aspect of the invention to adjust the time and the mode of the opening/closing of power doors. It is another aspect of the invention to provide a system that allows for fine adjustment of the cushioning initiation point without disassembly of the cylinder. It is still another aspect of the invention to provide a system wherein the cushioning initiation point can be adjusted so that the duration of the cushioning of the piston movement can be adjusted as needed. It is yet another aspect of the invention to provide an adjustable cushioning system wherein adjustment can be accomplished from outside of the cylinder.

Accordingly, the present invention is directed to a cushioning system for use with a pneumatic cylinder/differential engine door operator for driving a door between open and closed positions wherein the differential engine includes a large cylinder aligned with a small cylinder and a pair of associated pistons having a rack and pinion assembly connected therebetween and controlled by movement of the associated pistons. The cushioning system includes a large cap for sealing the large cylinder and a slider extending through the large cap and into the large cylinder. The slider is in fluid contact with an interior portion of the large cylinder. At least a first port having a first diameter extends through a first wall portion of the slider. At least a second port having a second diameter smaller than the first diameter extends through a second wall portion of the slider. The second sidewall portion is at a remote location from the first sidewall portion. A valve is associated with the slider for applying fluid through the first and second ports into the large cylinder during a door closing cycle and exhausting fluid through the first and second ports from within the large cylinder during a door opening cycle. A closing device is provided for sealing the slider near the end of a door opening cycle and eliminating the flow of exhaust through the first port so that the flow of exhaust only occurs through the second port and slows the forward movement of the pair of pistons. An adjusting device adjusts the linear extension of the slider into the large cylinder and adjusts the distance between the closing device and the slider for one of increasing and decreasing the amount of time before sealing of the slider occurs to adjust the point at which cushioning occurs during the door opening cycle.

The present invention is also directed to an adjustment assembly adapted for use with a cushioning system for a pneumatic cylinder/differential engine door operator. The adjustment assembly includes a cap for sealing a cylinder. A slider is mounted to the cap and into the cylinder. This slider is in fluid contact with an interior portion of the cylinder. A closing device seals the slider near the end of a door opening cycle, preventing the flow of exhaust through a first port so that the flow of exhaust occurs through a second port. This slows the forward movement of at least one piston. An adjusting device adjusts the linear extension of the slider into the cylinder and adjusts the distance between the closing device and the slider for one of increasing and decreasing the amount of time before sealing of the slider occurs to adjust the time at which cushioning occurs during the door opening cycle. This adjusting device includes a screw mounted to the slider and allows for the adjustment of cushioning cycle time without disassembling and/or replacing of parts within the pneumatic cylinder/differential engine door operator.

DETAILED DESCRIPTION OF THE INVENTION

Figure 1:
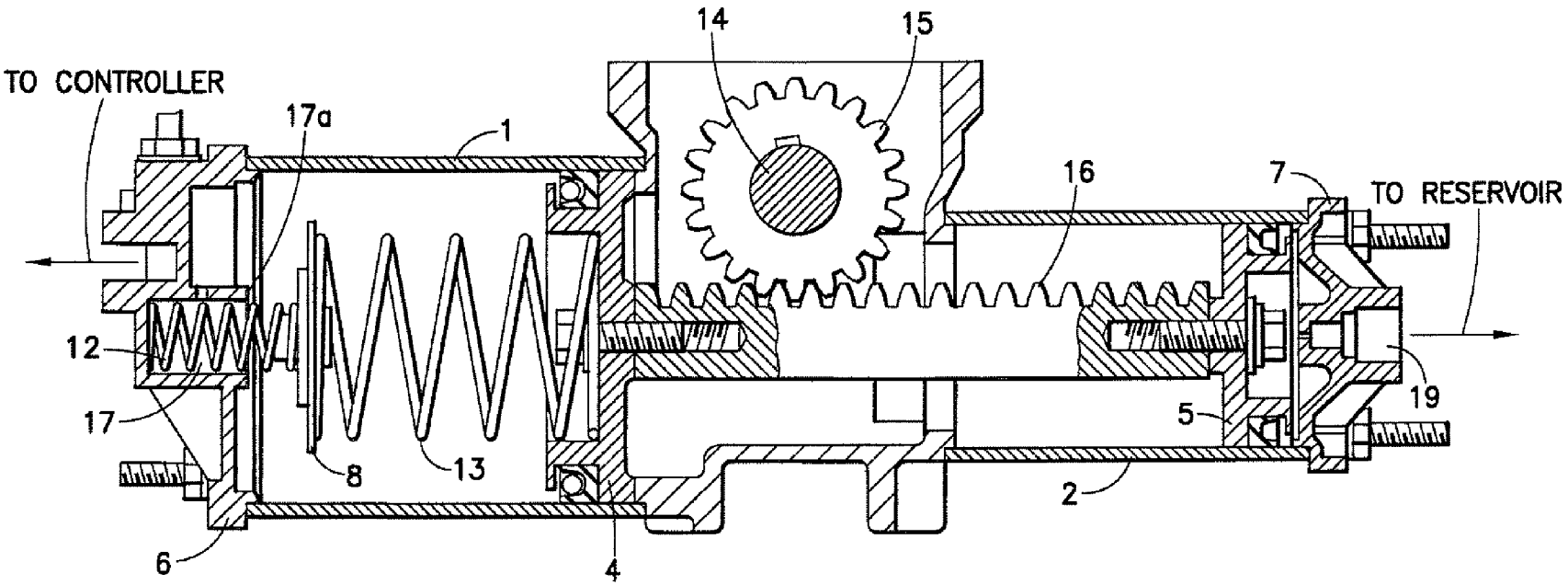
FIG. 1 PRIOR ART
FIG. 1 is a cross-sectional view of a pneumatic cylinder/differential engine of the prior art.
Figure 2:
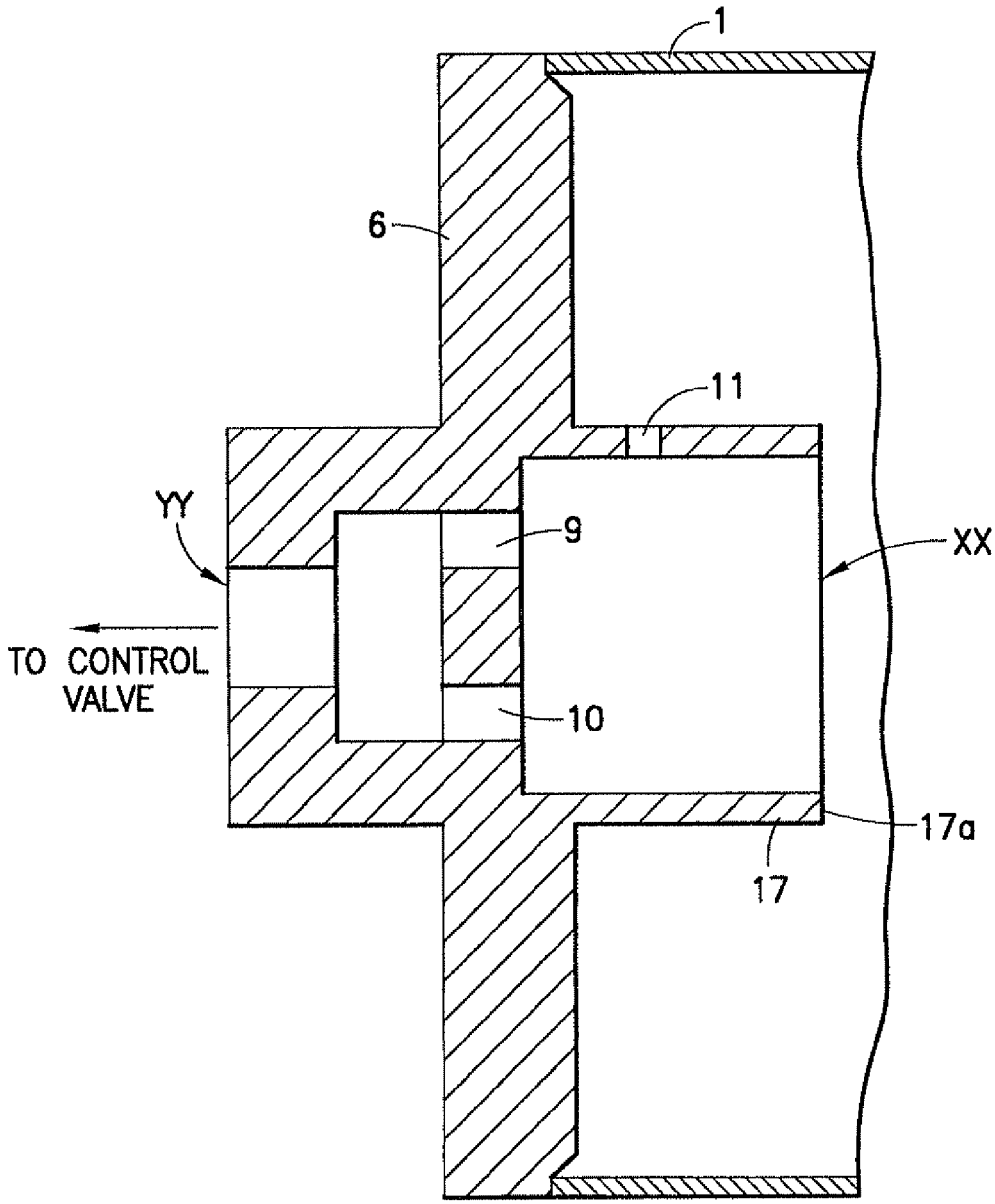
FIG.2 PRIOR ART
FIG. 2 is a view of the porting arrangement of the large cylinder end cap of the pneumatic cylinder/differential engine shown in FIG. 1.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 3:
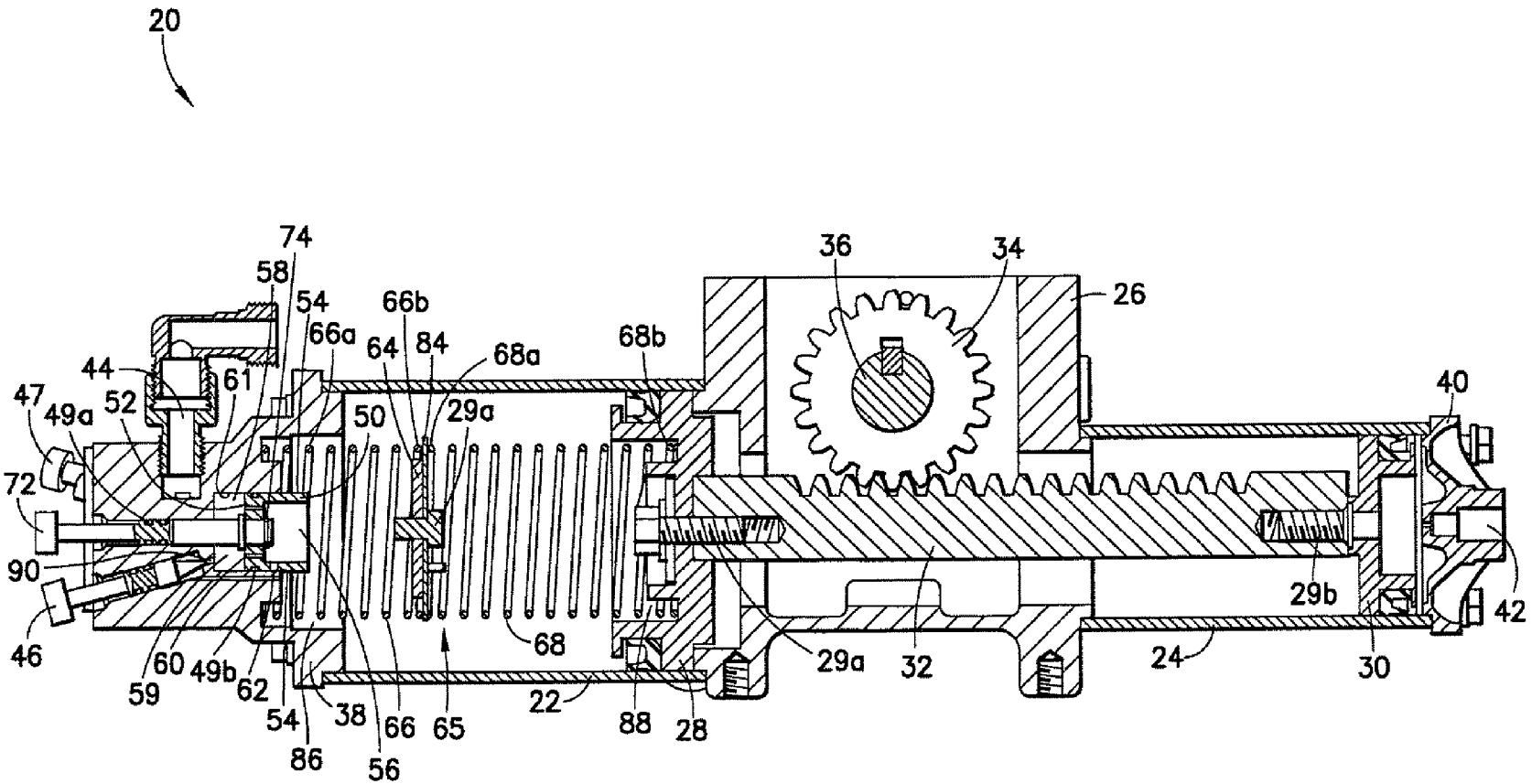
FIG. 3 is a cross-sectional view of the pneumatic cylinder/differential engine according to a first embodiment of the present invention at the start of a door opening cycle.
Figure 4:
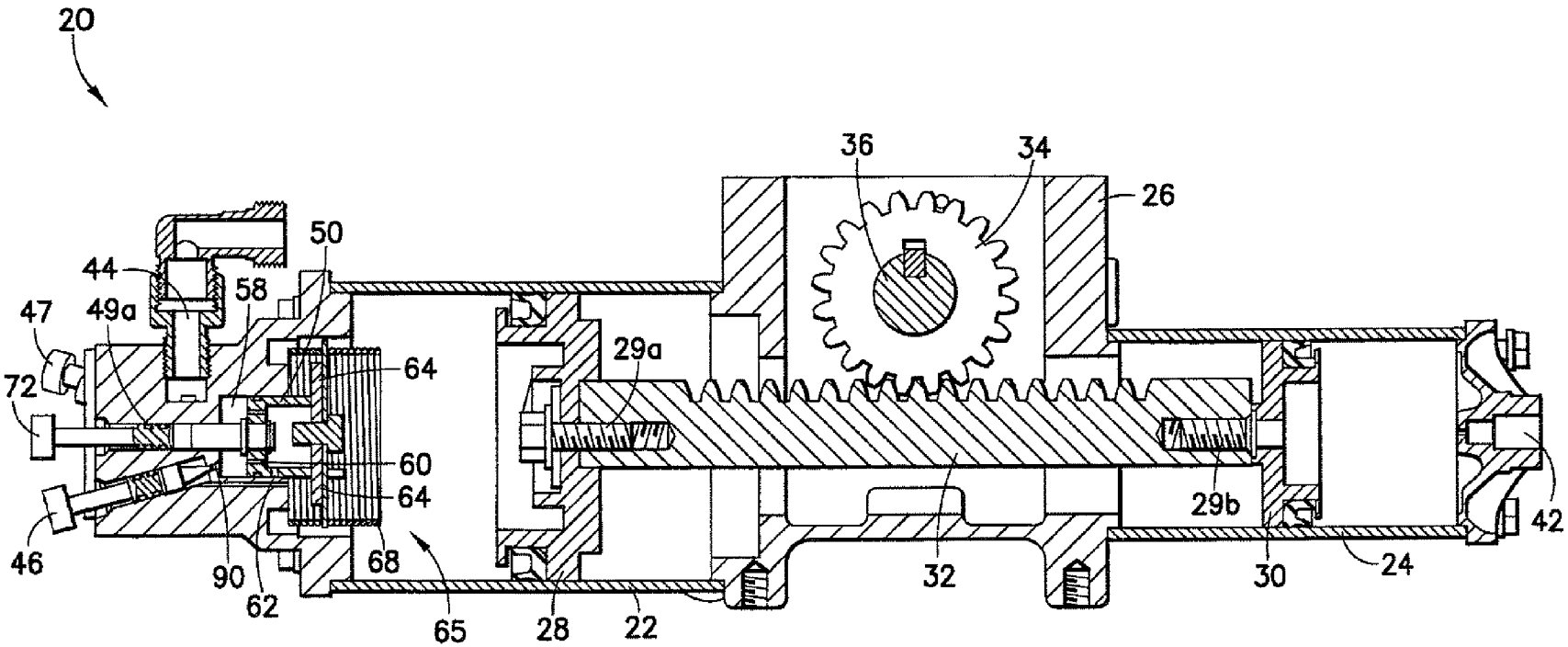
FIG. 4 is a cross-sectional view of the pneumatic cylinder/differential engine of FIG. 3 at the cushioning initiation point near the end of the door opening cycle.
Figure 5:
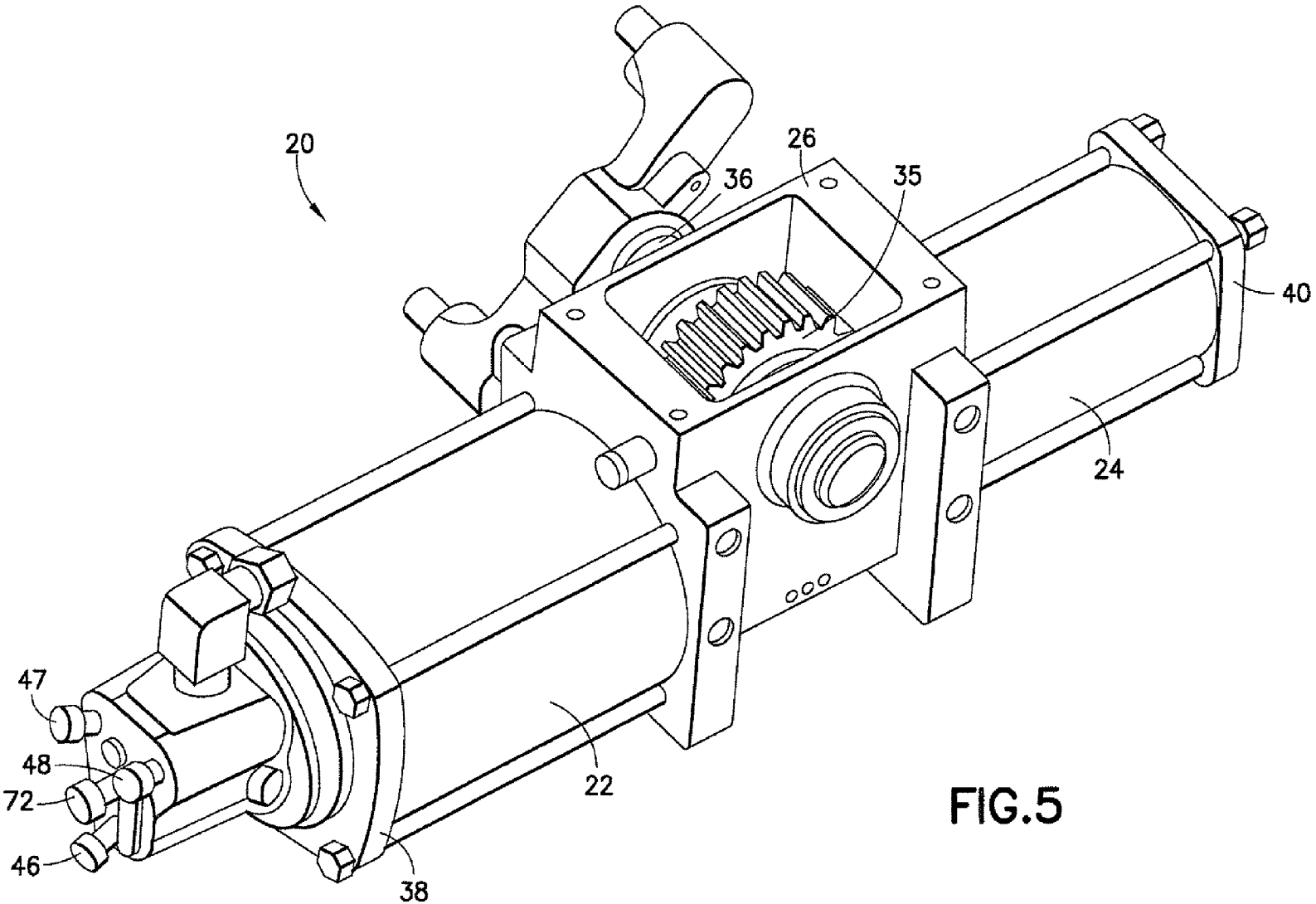
FIG. 5 is a cross-sectional view of the door opening and closing speed adjustment screws of the present invention.

Reference is now made to FIGS. 3 and 4, which show cross-sectional views of the pneumatic cylinder/differential engine according to a first embodiment of the present invention, generally indicated as 20, at the start of the door opening cycle and near the end of the door opening cycle where cushioning begins. The pneumatic cylinder/differential engine comprises a large cylinder 22 and a small cylinder 24 which are aligned with one another. A rack and pinion gear mechanism housing 26 is positioned in alignment between the large cylinder 22 and small cylinder 24. A large piston 28 is contained within the large cylinder 22 and a small piston 30 is contained within the small cylinder 24. A toothed rack 32 is connected via connecting screws 29*a*, 29*b* between the large piston 28 and small piston 30. Pinion gear 34 is engaged with toothed rack 32 and is connected to an output shaft 36 such that linear movement of the large piston 28 and small piston 30 results in rotational movement of the pinion gear 34 and output shaft 36 with respect to the toothed rack 32 to cause one of an opening cycle or a closing cycle of the door (not shown). A large cylinder cap 38 is positioned at one end of the large cylinder 22 and a small cylinder cap 40 is positioned at one end of the small cylinder 24. An opening 42 is provided in the small cylinder cap 40. This opening 42 is connected to a source of fluid pressure which applies a constant positive pressure of approximately 90-120 psi to the small piston 30. The large cylinder cap 38 is attached to a three-way valve (not shown) via a fitting 44. This valve is capable of applying a positive fluid pressure into the large cylinder 22 and against the large piston 28, thereby forcing the large piston, toothed rack 32 and small piston 30 to move linearly toward the right as shown in FIG. 3, and causing the pinion gear 34 to rotate in a counter-clockwise direction to initiate a door closing cycle. When a door opening cycle is desired, the valve allows air to be exhausted from within the large cylinder 22, thereby allowing the positive fluid pressure applied to the small piston 30 to linearly move the small piston 30, toothed rack 32 and large piston 28 to the left as shown in FIG. 4, and causing the pinion gear 34 to rotate in a clockwise direction, opening the vehicle door. As shown especially in FIGS. 5 and 6, the large cylinder cap includes a cushioning speed adjustment screw 46, a door closing speed adjustment screw 47, and a door opening speed adjustment screw 48. Appropriate O-rings 49*a*, 49*b* are provided in the device to achieve fluid tight seals of the individual components in the large cylinder cap 38.

The cushioning system of the invention comprises a cup-shaped slider 50, having a back wall 52, a pair of sidewalls 54 and a front opening 56. The slider 50 is positioned within a cup-shaped aperture 58 in the large cylinder cap 38. At least a first exhaust port 60, having a first predetermined diameter, extends through a first wall of the slider 50. Preferably the first exhaust port 60 extends through the back wall 52 of the slider 50 to exhaust air during the door opening cycle from within the large cylinder 22 into a trap portion 59 of aperture 58 located between a back portion of the slider 50 and the large cap 38 and subsequently out of the device through fitting 44. More than one first exhaust port 60 may be provided through this back wall 52 of the slider 50. At least a second exhaust port 62, having a second predetermined diameter which is smaller than the first predetermined diameter of the first exhaust port 60, extends through a second wall portion of the slider 50. This second wall portion preferably comprises one of the pair of sidewalls 54 and is at a remote location from the first sidewall portion. The slider 50 is seated within the aperture 58 such that only a portion of the sidewalls 54 of the slider are contacted by sidewalls 61 of the aperture 58. Sidewalls 61 do not extend past and/or seal the second exhaust port 62 in the sidewall 54 of the slider 50.

A closing device 64, typically in the form of a plate, is mounted by a biasing system, generally illustrated as 65. Preferably, this biasing system 65 comprises a pair of springs 66, 68, between which the closing device 64 is mounted. A first spring 66 has a first end 66*a* associated with and/or secured to cylinder cap 38 and a second end 66*b* secured to the closing device 64. A second spring 68 includes a first end 68*a* secured to the closing device 64 and a second end 68*b* associated and/or secured to the large piston 28. This closing device 64 is secured between the first and second springs 66, 68 by any well known securing member 70, such as a screw, post and the like. During an opening cycle, movement of the large piston 28 causes first and second springs 66, 68 to compress and bring closing device 64 into contact with the front opening 56 of the slider 50 to initiate a cushioning cycle near the end of the opening cycle piston stroke.

The contact of the closing device 64 with the opening 56 of the slider seals this opening 56 against the flow of exhaust air out of the large cylinder 22 through the first exhaust port 60. The flow of the exhaust air is now limited to escape through the second/smaller exhaust port 62 as this is the only exhaust port in fluid contact with the interior portion of the large cylinder 22. This sealing of opening 56 significantly slows down the forward movement of the piston stroke near the end of the opening cycle.

The slider 50 is attached to an end of a cushioning initiation point adjustment screw 72. Accordingly, should one require a longer or shorter cushioning cycle, slider 50 may be moved linearly within the large cylinder 22 closer to or farther away from the closing device 64. This adjustment of the cushioning cycle time/initiation point can occur without disassembling the pneumatic cylinder and without replacing springs 66, 68 with springs having different lengths and/or tensions. Additionally, the cushioning initiation point adjustment screw 72 may be readily accessed outside the pneumatic cylinder for easy adjustment and/or fine tuning of the initiation point with respect to closing device 64.

The magnitude of the linear motion of the slider 50 can be up to 50% of the length of the linear stroke of the large piston 28. Connection between the slider 50 and cushioning initiation point adjustment screw 72 can be made, for example, by a retaining ring 74 mounted on the adjustment screw which enters through a port 76 in the back wall 52 of the slider 50.

The cushioning initiation point is defined by the moment when closing device/plate 64 seals the face or front opening 56 of the slider 50. This moment can be adjusted by moving the slider 50 along the axis of the pneumatic cylinder so that the closing device 64 will contact the slider front opening 56 earlier in relation to the movement of the piston 28, or later, at the end of the movement of the piston 28. This linear adjustment is provided by rotation of the cushion initiation point adjustment screw 72. In practice, the adjustment of the cushioning initiation point depends on the range of motion of the slider 50, and cushioning can be adjusted to start at a point between 30 to 90% of the full rotation of the output shaft. The adjustment of the cushioning initiation point enables the field adjustment cycle of the opening/closing of the powered doors without disassembly of the cylinder.

The invention can be clarified by an analysis of the air flow and piston movement in different cycles of the cylinder/engine. Opening 42 of the small cylinder 24 is always connected to the source of compressed air (100-120 psi). Fitting 44 connects port 76 to a three-way valve, allowing connection of the port 76 to compressed air or to exhaust (atmospheric pressure) for removing air.

Figure 6:
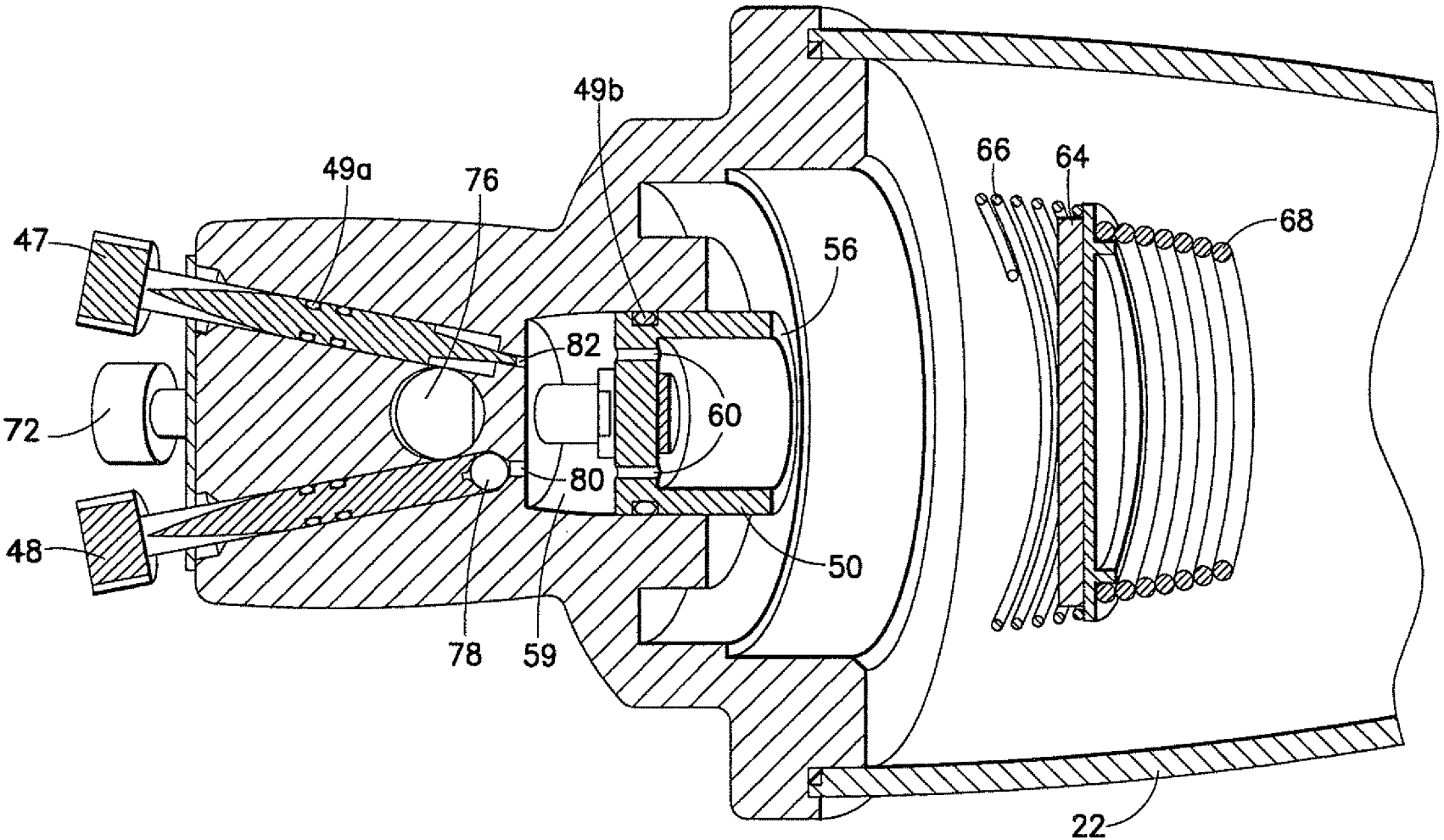
FIG. 6 is a perspective view of the pneumatic cylinder/differential engine of the present invention.

During a door closing cycle, port 76 associated with fitting 44 is connected to the source of the compressed air. A ball 78, as shown in FIG. 6, closes a connecting hole 80 of the door opening speed adjustment screw 48 so air can enter into the large cylinder 22 only through the hole 82 of the door closing speed adjustment screw 47. Compressed air enters into the trap 59 of the cap 38 and flows through the ports 60 of the slider 50 into the cup-shaped portion of the slider. At the beginning of the closing cycle, this cavity of the slider 50 is sealed by the closing device or sealing disk 64 attached to a retainer 84. The pressure on the sealing disk 64 forces movement of the sealing disk 64 and retainer 84 to the right, opening the front opening cup 56 of the shaped slider 50, and allowing compressed air to enter into the cavity of the large cylinder 22. Because of the difference in the diameters of the pistons 28 and 30, the force acting on piston 28 is greater than the force acting on piston 30, and as a result pistons 28 and 30, connected by the rack 32, move to the right, causing the rotation of the pinion gear 34 in a counter-clockwise direction. The output shaft 36 drives the power door opening/closing mechanism. Rotation of the shaft 36 in a counter-clockwise direction causes closing of the power doors. Air flow into the cylinder, or door closing speed, can be adjusted by rotation of the screw 47. The movement of the pistons stops when the right side of the piston 28 contacts the surface of the pinion gear housing 26.

The ends of the springs 66 and 68 are attached to the retainer 84. The opposite end of the spring 66 is located in a cavity 86 of the large cylinder cap 38, and the opposite end of the spring 68 is located in a cavity 88 of the large piston 28. This arrangement allows the retainer 84, and accordingly sealing disk or closing device 64 attached to the retainer 84, to move between piston 28 and cap 38.

When the piston 28 moves to the right, the retainer 84 also moves to the right, and the gap between sealing disk 64 and opening 56 of the slider 50 increases. However, the movement of the retainer 84 does not exactly follow the movement of the piston 28 because the coefficient of elasticity of spring 66 is greater than the coefficient of elasticity of spring 68, and because the lengths of springs 66 and 68 are different.

During a door opening cycle, port 74 is connected through fitting 44 to the exhaust (atmospheric pressure). The opening cycle consists of two parts: opening without cushioning and opening with cushioning.

Opening of the power door without cushioning: When three-way valve connects the port 76 to the exhaust, the pressure gradient causes the ball 78 to move and open the hole 80, allowing air flow through the cavity to the port 76. The flow rate through hole 80, and hence the door opening speed, can be adjusted by screw 48. The air flows out of the cavity of the large cylinder 22 through the ports 60 in the slider wall into the cavity or trap 59 between slider 50 and cap 38, and through the holes 80 and 82 to the port 76. At the same time, air can flow into trap 59 through the small port 62 and a hole 90 of the cushion speed adjustment screw 46. However, the diameter of the port 62 is substantially less than the diameter of the holes 80 and 82. Therefore, the flow of the air through the holes 80 and 82 is significantly greater than the flow through the port 62. As a result, the pressure in the cavity of the large cylinder 22 quickly decreases, causing the force acting on the small piston 30 to exceed the force acting on the large piston 28, and pistons 30, 28 and rack 32 start moving to the left. The linear movement of the rack 32 causes the clockwise rotation of the pinion gear 34 and output shaft 36 and, accordingly, the opening of the doors. The movement of the piston 28 will cause the compression of the spring 68 and will cause the movement of the retainer 84 to the left. The rapid linear motion of pistons 28 and 30 continues until (a) the sealing disk 64 contacts with the front opening 56 of the slider 50 and (b) the force of the spring 68 acting on retainer 84 becomes sufficient to seal front opening 56 of the slider 50 from the cavity of the large cylinder 22. Because of the decrease in air flow out of the cylinder, the movement of the piston slows and cushioning is initiated.

Opening of the power door with cushioning: As described above, the movement of the piston 28 causes the compression of the spring 68 and the sealing of opening 56 of the slider 50. As a result, the air enters the trap 59 of the cap 38 only through the passage created by the port 62 and hole 90. The air flow through the hole 90 can be increased or decreased by adjusting screw 46. Because the flow rate through the ports 62 and 90 is significantly less than the flow rate through the port 60 of the slider 50, the movement of the piston 28 is significantly slowed or cushioned, which causes the cushioning of the powered doors at the end of the opening cycle.

Figure 7:
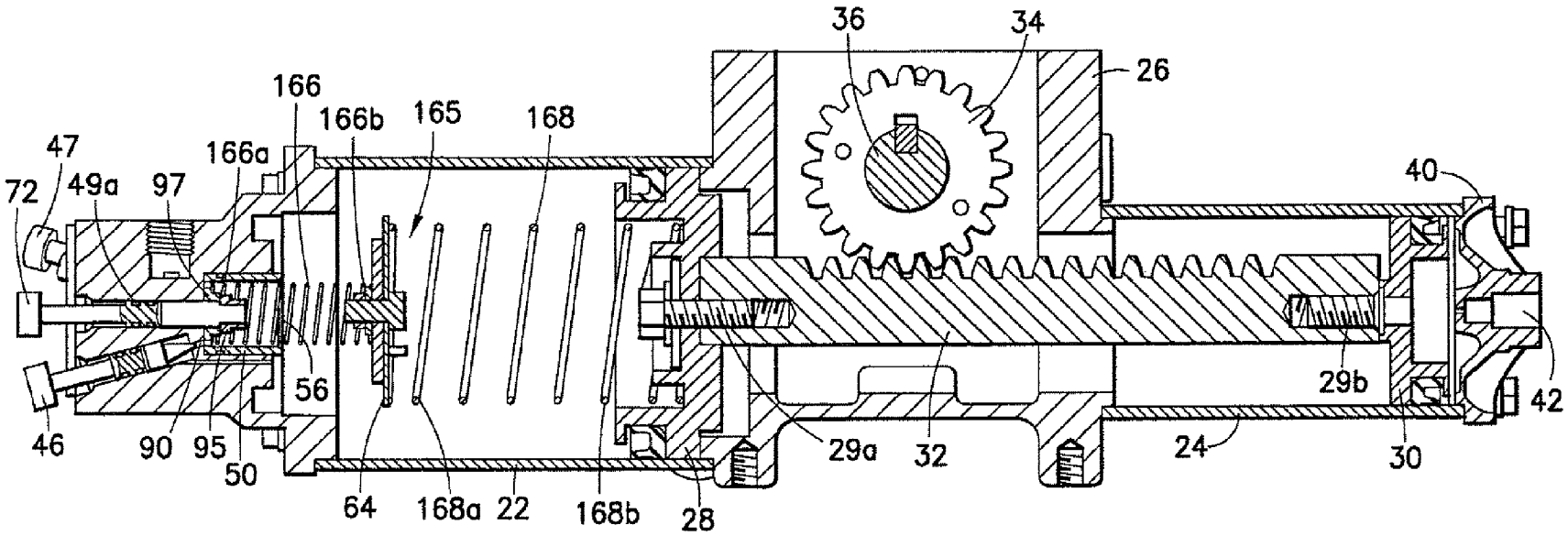
FIG. 7 is a cross-sectional view of the pneumatic cylinder/differential engine according to a second embodiment of the present invention at the start of a door opening cycle.

Reference is now made to FIG. 7, which shows a cross-sectional view of the pneumatic cylinder/differential engine according to a second embodiment of the invention. In this embodiment, biasing system, generally illustrated as 165, includes a pair of springs 166, 168 between which the closing device 64 is mounted. This mounting is achieved by any well known means such as discussed in detail above with respect to the FIG. 3 embodiment. In this second embodiment, a first spring 166 includes a first end 166*a*, which is located within and supported by the slider 50. First spring 166 also includes a second end 166*b* which is secured to the closing device 64. A second spring 168 includes a first end 168*a* secured to closing device 64 and a second end 168*b* associated with and/or secured to the large piston 28. The slider 50 is attached to the adjustment screw 72 by any well-known attachment means, for example, a nut 95 and a lock-washer 97. During a door opening cycle, movement of the large piston 28 causes first and second springs 166, 168 to compress and bring the closing device 64 into contact with the front opening 56 of the slider 50 to initiate a cushioning cycle near the end of the opening cycle. As discussed in detail above, adjustment screw 72 linearly adjusts the distance between the slider 50 and the closing device 64 to adjust the length of time of the cushioning cycle. This adjustment is readily achieved without the time consuming and costly process of disassembling the pneumatic cylinder and replacing of the first and second springs 166, 168 with springs having different lengths and/or tensions.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of this description. For example, it is to be understood that the present invention contemplates that, to the extent possible, one or more features of any embodiment can be combined with one or more features of any other embodiment.

The invention claimed is:

1. A cushioning system for use with a pneumatic cylinder/differential engine door operator for driving a door between open and closed positions wherein said differential engine includes a large cylinder aligned with a small cylinder and large and small associated pistons having a rack and pinion assembly connected between and controlled by movement of said associated pistons, said cushioning system comprising:

(a) a large cap for sealing said large cylinder;

(b) a slider extending from said large cap and into said large cylinder, said slider being in fluid contact with an interior portion of said large cylinder;

(c) at least a first port having a first diameter extending through a first wall portion of said slider;

(d) at least a second port having a second diameter smaller than said first diameter and extending through a second wall portion of said slider, said second sidewall portion being at a remote location from said first sidewall portion;

(e) a valve associate with said slider for applying fluid through said first and second ports into said large cylinder during a door closing cycle and exhausting fluid through said first and second ports from within said large cylinder during a door opening cycle;

(f) a closing device for sealing said slider near the end of a door opening cycle, preventing the flow of exhaust through said first port so that the flow of exhaust occurs through the second port and slowing the forward movement of said pair of pistons, said closing device moveable relative to said large piston;

(g) a biasing system for mounting said closing device with respect to said large cap and said slider, said biasing system adapted for linearly moving said closing device with respect to said large cap and said slider; and (h) an adjusting device for adjusting the linear extension of said slider into said large cylinder and adjusting the distance between said closing device and said slider for one of increasing and decreasing the amount of time before sealing of the slider occurs to adjust the time at which cushioning occurs during the door opening cycle.

2. The system of claim 1 wherein the adjusting device comprises a screw attached to said slider.

3. The system of claim 1 wherein the adjusting device comprises a screw attached to said slider by a nut and lock-washer.

4. The system of claim 1 wherein the adjusting device can be controlled externally from said pneumatic cylinder/differential engine door operator.

5. The system of claim 1 wherein said slider comprises a cup-shaped member having a back wall, two sidewalls and an open front portion facing the interior portion of said large cylinder.

6. The system of claim 5 wherein said open front portion of said slider is sealed by said closing device to initiate cushioning near the end of said door opening cycle.

7. The system of claim 5 wherein said adjusting device includes a retaining ring that enters through an aperture extending through a back wall of said slider.

8. The system of claim 5 wherein said first port extends through said back wall of said slider and said second port extends through one of said sidewalls of said slider.

9. The system of claim 5 wherein said large cap includes a cup-shaped aperture for receiving at least a portion of said cup-shaped retainer member.

10. The system of claim 9 wherein said cup-shaped aperture in said large cap includes sidewalls extending a predetermined distance along the length of said sidewalls of said slider.

11. The system of claim 10 wherein said at least a portion of one of said sidewalls of said slider includes said second port and said portion of one of said sidewalls of said slider extends beyond the length of said sidewalls of said cup-shaped aperture so that fluid contact is maintained between the interior portion of said large cylinder and an interior portion of said cup-shaped slider during cushioning.

12. The system of claim 5 wherein said first port comprises a pair of ports extending through said back wall of said cup-shaped slider.

13. The system of claim 1 wherein said biasing system comprises a pair of springs and said closing device is secured between said pair of springs.

14. The system of claim 13 wherein said pair of springs comprises a first spring and a second spring, said first spring having a first end secured to said cylinder cap and a second end secured to said closing device; and said second spring having a first end secured to said closing device and a second end secured to said large piston.

15. The system of claim 13 wherein said pair of springs comprises a first spring and a second spring, said first spring having a first end located within and supported by said slider and a second end secured to said closing device; and said second spring having a first end secured to said closing device and a second end secured to said large piston.

16. An adjustment assembly associated with a cushioning system for a pneumatic cylinder/differential engine door operator wherein said differential engine includes a large cylinder aligned with a small cylinder and large and small associated pistons having a rack and pinion assembly connected between and controlled by movement of said associated pistons, said adjustment assembly comprising:

(a) a cap for sealing a cylinder;

(b) a slider extending from said cap and into said cylinder, said slider being in fluid contact with an interior portion of said cylinder;

(c) a closing device for sealing said slider near the end of a door opening cycle, preventing the flow of exhaust through a first port so that the flow of exhaust occurs through a second port and slowing the forward movement of at least one piston, said closing device moveable relative to said large piston; and (d) an adjusting device for adjusting the linear extension of said slider into said cylinder and adjusting the distance between said closing device and said slider for one of increasing and decreasing the amount of time before sealing of the slider occurs to adjust the time at which cushioning occurs during the door opening cycle.

17. The adjustment assembly of claim 16 including a biasing system for mounting said closing device with respect to said cap and said slider, said biasing system adapted for linearly moving said closing device with respect to said cap and said slider.

18. The adjustment assembly of claim 17 wherein said biasing system comprises a first spring and a second spring, said first spring having a first end secured to said cylinder cap and a second end secured to said closing device; and said second spring having a first end secured to said closing device and a second end secured to said at least one piston.

19. The adjustment assembly of claim 17 wherein said biasing system comprises a first spring and a second spring, said first spring having a first end located within and supported by said slider and a second end secured to said closing device and said second spring having a first end secured to said closing device; and a second end secured to said at least one piston.

20. The adjustment assembly of claim 19 wherein said adjusting device comprises a screw attached to said slider by a nut and lock-washer assembly.

* * * * *

UNITED STATES PATENT AND TRADEMARK OFFICE

CERTIFICATE OF CORRECTION

PATENT NO. : 8,528,459 B2
APPLICATION NO. : 12/532491
DATED : September 10, 2013
INVENTOR(S) : Gennady Plavnik It is certified that error appears in the above-identified patent and that said Letters Patent is hereby corrected as shown below:

In the Claims

Column 8, Line 35, Claim 1, delete “associate” and insert -- associated --

Column 9, Line 12, Claim 9, delete “retainer member” and insert -- member. --

Signed and Sealed this
Fourth Day of February, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,528,459 B2
APPLICATION NO. : 12/532491
DATED : September 10, 2013
INVENTOR(S) : Gennady Plavnik It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1003 days.

Signed and Sealed this
Fifteenth Day of September, 2015

Michelle K. Lee

Michelle K. Lee
*Director of the United States Patent and Trademark Office*